US010830513B2

(12) United States Patent
Higashiiue et al.

(10) Patent No.: US 10,830,513 B2
(45) Date of Patent: Nov. 10, 2020

(54) DISTRIBUTOR, LAYERED HEADER, HEAT EXCHANGER, AND AIR-CONDITIONING APPARATUS

(71) Applicant: Mitsubishi Electric Corporation, Tokyo (JP)

(72) Inventors: Shinya Higashiiue, Tokyo (JP); Shigeyoshi Matsui, Tokyo (JP); Takehiro Hayashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 216 days.

(21) Appl. No.: 15/748,223

(22) PCT Filed: Sep. 7, 2015

(86) PCT No.: PCT/JP2015/075350
§ 371 (c)(1),
(2) Date: Jan. 29, 2018

(87) PCT Pub. No.: WO2017/042866
PCT Pub. Date: Mar. 16, 2017

(65) Prior Publication Data
US 2018/0216858 A1 Aug. 2, 2018

(51) Int. Cl.
*F25B 41/00* (2006.01)
*F28F 9/02* (2006.01)
(Continued)

(52) U.S. Cl.
CPC ..... *F25B 41/003* (2013.01); *F25B 41/00* (2013.01); *F25B 41/043* (2013.01);
(Continued)

(58) Field of Classification Search
CPC ..... F25B 41/003; F25B 41/00; F25B 41/067; F25B 41/043; F28F 9/02; F28F 13/08;
(Continued)

(56) References Cited

U.S. PATENT DOCUMENTS 4,232,728 A * 11/1980 Fenner ..... F28F 13/08 165/133
5,241,839 A * 9/1993 Hughes ..... B60H 1/3227 165/174
(Continued)

FOREIGN PATENT DOCUMENTS

JP H05-126355 A 5/1993
JP H09-189463 A 7/1997
(Continued)

OTHER PUBLICATIONS

Extended European Search Report dated Aug. 27, 2018 issued in corresponding EP patent application No. 15903532.8.
(Continued)

*Primary Examiner* — Ljiljana V. Ciric
(74) *Attorney, Agent, or Firm* — Posz Law Group, PLC

(57) ABSTRACT

A distributor includes a first communication flow path, a second communication flow path, and a bent portion connecting the first communication flow path and the second communication flow path. The second communication flow path includes an inner wall portion extending from the bent portion and an outer wall portion extending from the outer peripheral wall portion of the bent portion. The outer wall portion has a liquid film separation unit, which is a boundary between a relatively narrow section and a relatively wide section of the second communication flow path.

9 Claims, 12 Drawing Sheets

(51) Int. Cl.

| | |
|---|---|
| ***F25B 41/04*** | (2006.01) |
| ***F25B 41/06*** | (2006.01) |
| ***F28D 1/047*** | (2006.01) |
| ***F28F 13/08*** | (2006.01) |
| ***F28D 21/00*** | (2006.01) |

(52) U.S. Cl.
CPC ..... *F25B 41/067* (2013.01); *F28D 1/0478* (2013.01); *F28F 9/02* (2013.01); *F28F 9/0221* (2013.01); *F28F 9/0278* (2013.01); *F28F 13/08* (2013.01); *F28D 2021/007* (2013.01); *F28D 2021/0071* (2013.01)

(58) Field of Classification Search
CPC ..... F28F 9/0278; F28F 9/0221; F28D 1/0478; F28D 2021/0071; F28D 2021/007
See application file for complete search history.

(56) References Cited

U.S. PATENT DOCUMENTS

| | | | | |
|---|---|---|---|---|
| 5,242,016 | A * | 9/1993 | Voss | F25B 39/028 165/173 |
| 5,261,485 | A * | 11/1993 | Thornton | C02F 1/22 165/115 |
| 6,892,805 | B1 * | 5/2005 | Valensa | F28F 9/0278 165/173 |
| 10,048,024 | B1 * | 8/2018 | Sole | F28D 1/05341 |
| 10,571,205 | B2 * | 2/2020 | Higashiiue | F28D 1/05333 |
| 2003/0079863 | A1 * | 5/2003 | Sugito | F28D 15/0266 165/104.21 |
| 2003/0152488 | A1 * | 8/2003 | Tonkovich | B01F 5/0604 422/400 |
| 2003/0188857 | A1 * | 10/2003 | Kawakubo | F28D 1/0476 165/174 |
| 2004/0050538 | A1 * | 3/2004 | Sunder | F25J 5/002 165/133 |
| 2013/0174924 | A1 * | 7/2013 | Luo | F28F 9/0221 137/561 A |
| 2016/0116231 | A1 | 4/2016 | Higashiiue et al. | |
| 2016/0169595 | A1 | 6/2016 | Matsuda et al. | |
| 2016/0178292 | A1 | 6/2016 | Matsui et al. | |
| 2018/0216858 | A1 * | 8/2018 | Higashiiue | F25B 41/00 |
| 2020/0025427 | A1 * | 1/2020 | Higashiiue | F25B 41/00 |

FOREIGN PATENT DOCUMENTS

| | | | |
|---|---|---|---|
| JP | 2003-121029 | A | 4/2003 |
| WO | 2014/184914 | A1 | 11/2014 |
| WO | 2014/185391 | A1 | 11/2014 |
| WO | 2015/045073 | A1 | 4/2015 |

OTHER PUBLICATIONS

International Search Report of the International Searching Authority dated Nov. 24, 2015 for the corresponding international application No. PCT/JP2015/075350 (and English translation).

* cited by examiner

DISTRIBUTOR, LAYERED HEADER, HEAT EXCHANGER, AND AIR-CONDITIONING APPARATUS

CROSS REFERENCE TO RELATED APPLICATION

This application is a U.S. national stage application of International Application No. PCT/JP2015/075350, filed on Sep. 7, 2015, the contents of which are incorporated herein by reference.

TECHNICAL FIELD

The present invention relates to a distributor used for a heating circuit or other circuits, a layered header, a heat exchanger, and an air-conditioning apparatus.

BACKGROUND

A heat exchanger is configured of a flow path (path) in which a plurality of heat transfer tubes are arranged in parallel, to mitigate a pressure loss of refrigerant flowing in the heat transfer tubes. Each heat transfer tube is provided with, for example, a header or a distributor that is a distribution device for equally distributing refrigerant to respective heat transfer tubes, at a refrigerant entering part thereof.

It is important to uniformly distribute refrigerant to the heat transfer tubes for securing the heat transfer property of the heat exchanger.

The distribution device is configured such that a plurality of plate bodies are layered to form a distribution flow path for dividing one inlet flow path into a plurality of outlet flow paths to thereby distributively supply refrigerant to the respective heat transfer tubes of the heat exchanger (for example, see Patent Literature 1).

PATENT LITERATURE

Patent Literature 1: Japanese Unexamined Patent Application Publication No. 9-189463

In such a distribution device, when refrigerant or the like containing liquid flows into the distribution flow path having a bent portion, the liquid flows in a biased manner in the outer peripheral direction of the distribution flow path by the centrifugal force. In that case, at a branch portion provided downstream of the flow path, a large portion of the liquid flows into a particular flow path. This causes a problem that the distribution ratio of the refrigerant is not uniform at the outlet of the distribution flow path.

SUMMARY

The present invention has been made in view of the aforementioned problem. An object of the present invention is to provide a distributor, a layered header, a heat exchanger, and an air-conditioning apparatus, capable of uniformly supplying refrigerant at an outlet of a distribution flow path.

A distributor according to one embodiment of the present invention includes a first flow path; a plurality of second flow paths; and a first branch flow path for dividing the first flow path into the plurality of second flow paths, the first branch flow path including a first communication flow path communicating with the first flow path; a second communication flow path communicating with each of the second flow paths; and a bent portion connecting the first communication flow path and the second communication flow path, the bent portion including an inner peripheral wall portion including an inner face having a first radius of curvature, and an outer peripheral wall portion including an inner face having a second radius of curvature larger than the first radius of curvature, the second communication flow path including an inner wall portion extending from the inner peripheral wall portion of the bent portion, and an outer wall portion extending from the outer peripheral wall portion of the bent portion, the outer wall portion having a liquid film separation unit.

The distributor according to one embodiment of the present invention is configured such that a bent portion is provided in a flow path, and even when a liquid component of refrigerant flows in a biased manner on the outer peripheral side of the bent portion by the centrifugal force, the bias of the liquid can be corrected by the liquid film separation unit. Accordingly, it is possible to uniformly distribute the liquid to a plurality of flow paths.

DETAILED DESCRIPTION

Figure 1:
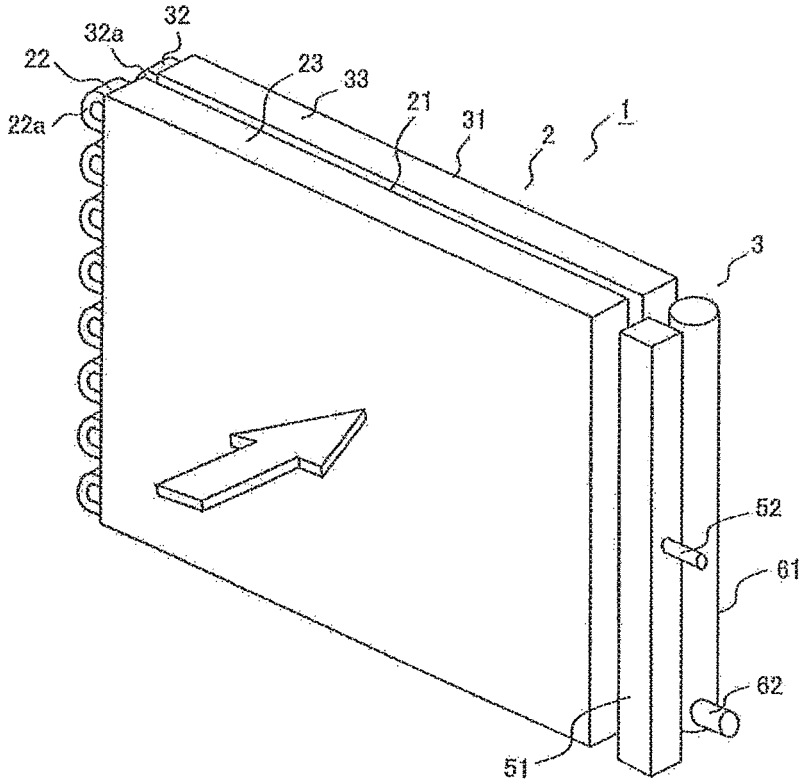
FIG. 1 is a perspective view of a heat exchanger 1 according to Embodiment 1.

Hereinafter, a distributor, a layered header, a heat exchanger, and an air-conditioning apparatus of the present invention will be described with reference to the drawings.

It should be noted that configurations, operations, and other features described below are provided for illustrative purposes, and a distributor, a layered header, a heat exchanger, and an air-conditioning apparatus of the present invention are not limited to such configurations, operations, and other features. Further, in the drawings, same or similar parts may be denoted by the same reference numerals, or not denoted by a reference numeral. Further, fine structures are simply illustrated or not illustrated as appropriate. Further, overlapping or similar description may be simplified or omitted as appropriate.

Further, while description is given on the case where a distributor, a layered header, or a heat exchanger of the present invention is applied to an air-conditioning apparatus, the present invention is not limited to such a case. For example, the present invention may be applicable to another refrigeration cycle device having a refrigerant cycle circuit. Further, while description is given on the case where a distributor, a layered header, and a heat exchanger of the present invention are of an outdoor heat exchanger of an air-conditioning apparatus, the present invention is not limited to such a case. An indoor heat exchanger of an air-conditioning apparatus is also applicable. Further, while description is made on the case where an air-conditioning apparatus performs switching between heating operation and cooling operation, the present invention is not limited to such a case. The present invention may perform either heating operation or cooling operation.

Embodiment 1

A distributor, a layered header, a heat exchanger, and an air-conditioning apparatus, according to Embodiment 1, will be described.

<Configuration of Heat Exchanger 1>

Hereinafter, a schematic configuration of the heat exchanger 1 according to Embodiment 1 will be described.

FIG. 1 is a perspective view of the heat exchanger 1 according to Embodiment 1.

Figure 2:
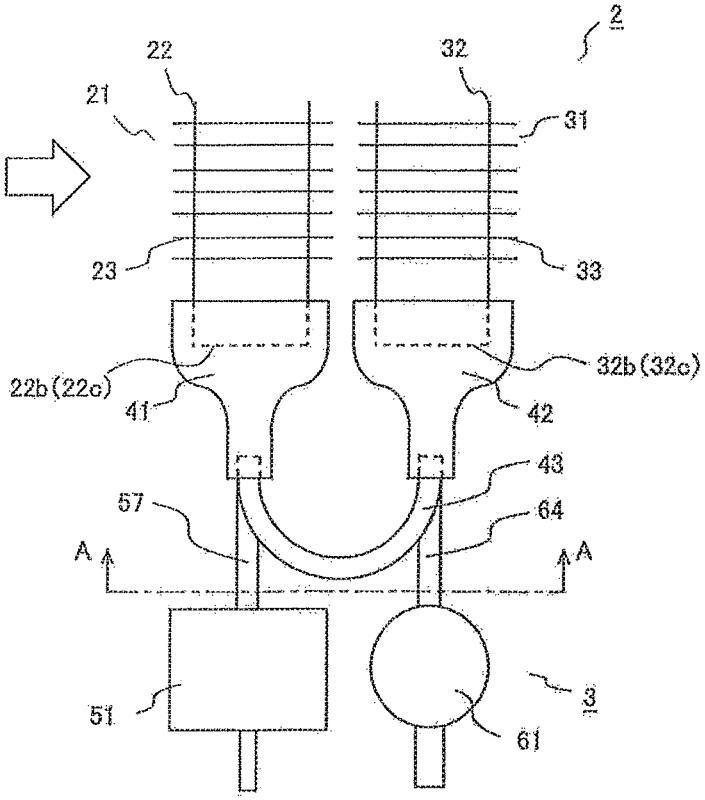
FIG. 2 illustrates connection between a heat exchanger unit 2 and a confluence unit 3 of the heat exchanger 1 according to Embodiment 1.
Figure 3:
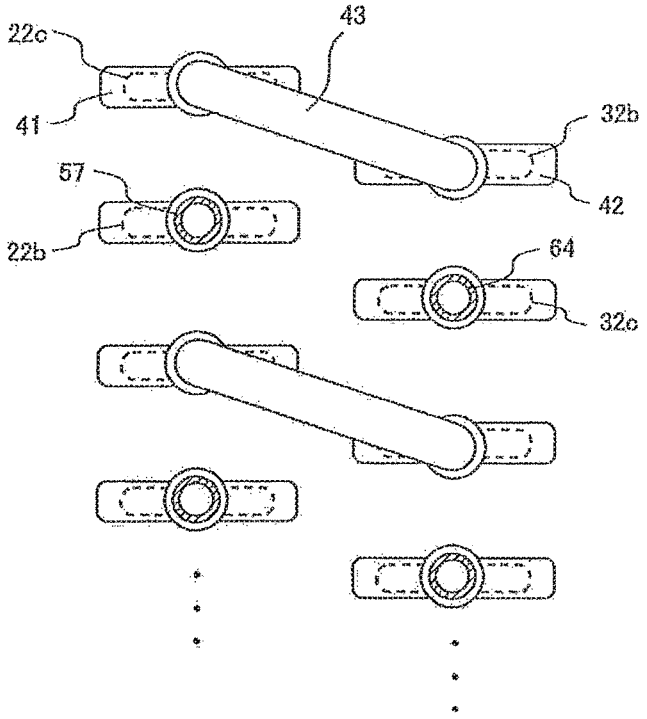
FIG. 3 illustrates connection between the heat exchanger unit 2 and the confluence unit 3 of the heat exchanger 1 according to Embodiment 1.

FIGS. 2 and 3 illustrate connection between a heat exchanger unit 2 and a confluence unit 3 of the heat exchanger 1 according to Embodiment 1. It should be noted that FIG. 3 is a cross-sectional view taken along a line A-A of FIG. 2.

As illustrated in FIG. 1, the heat exchanger 1 includes the heat exchanger unit 2 and the confluence unit 3.

(Heat Exchanger Unit 2)

The heat exchanger unit 2 includes an air-upstream side heat exchanger unit 21 provided on the air-upstream side of the passing direction (void arrow in the drawing) of the air passing through the heat exchanger unit 2, and a air-downstream side heat exchanger unit 31 provided on the air-downstream side thereof. The air-upstream side heat exchanger unit 21 includes a plurality of air-upstream side heat transfer tubes 22, and a plurality of air-upstream side fins 23 joined to the air-upstream side heat transfer tubes 22 by brazing, for example. The air-downstream side heat exchanger unit 31 includes a plurality of air-downstream side heat transfer tubes 32, and a plurality of air-downstream side fins 33 joined to the air-downstream side heat transfer tubes 32 by brazing, for example. It should be noted that while the heat exchanger unit 2 configured of two rows, namely the air-upstream side heat exchanger unit 21 and the air-downstream side heat exchanger unit 31, is shown as an example, it may be configured of three or more rows.

Each of the air-upstream side heat transfer tube 22 and the air-downstream side heat transfer tube 32 is a flat tube, for example, and has a plurality of flow paths therein. Each of the air-upstream side heat transfer tubes 22 and the air-downstream side heat transfer tubes 32 is configured such that a substantially intermediate portion between one end 22*b* and the other end 22*c* is bent in a hairpin shape to form a folded portion 22*a*, 32*a* to be in a substantially U shape. The air-upstream side heat transfer tubes 22 and the air-downstream side heat transfer tubes 32 are disposed in a plurality of stages in a direction orthogonal to the passing direction (void arrow in the drawing) of the air passing through the heat exchanger unit 2. It should be noted that each of the air-upstream side heat transfer tube 22 and the air-downstream side heat transfer tube 32 may be a circular tube (circular tube with a diameter of 4 mm, for example).

While description has been given on the example in which the air-upstream side heat transfer tube 22 and the air-downstream side heat transfer tube 32 are bent in a U shape and the folded portions 22*a* and 32*a* are integrally formed, it is also possible to form the folded portions 22*a* and 32*a* as different members. In that case, a U tube having a flow path therein may be connected to form a folded flow path.

(Confluence Unit 3)

The confluence unit 3 includes a layered header 51 and a cylindrical header 61. The layered header 51 and the cylindrical header 61 are arranged in parallel along the passing direction (void arrow in the drawing) of the air passing through the heat exchanger unit 2. To the layered header 51, a refrigerant pipe (not illustrated) is connected via a connection pipe 52. To the cylindrical header 61, a refrigerant pipe (not illustrated) is connected via a connection pipe 62. Each of the connection pipe 52 and the connection pipe 62 is a circular pipe, for example.

Inside the layered header 51 functioning as a distributor, a confluence flow path 51*a* connected to the air-upstream side heat exchanger unit 21 is formed. The confluence flow path 51*a* serves as a distribution flow path that allows refrigerant flowing from a refrigerant pipe (not illustrated) to distributively flow out to a plurality of air-upstream side heat transfer tubes 22 of the air-upstream side heat exchanger unit 21, when the heat exchanger unit 2 acts as an evaporator. Further, when the heat exchanger unit 2 acts as a condenser, the confluence flow path 51*a* serves as a confluence flow path that merges refrigerant flowing from the air-upstream side heat transfer tubes 22 of the air-upstream side heat exchanger unit 21 and allows the refrigerant to flow to a refrigerant pipe (not illustrated).

Inside the cylindrical header 61, a confluence flow path 61*a* connected to the air-downstream side heat exchanger unit 31 is formed. The confluence flow path 61*a* serves as a distribution flow path that allows refrigerant flowing from a refrigerant pipe (not illustrated) to distributively flow to the air-downstream side heat transfer tubes 32 of the air-downstream side heat exchanger unit 31, when the heat exchanger unit 2 acts as a condenser. Further, when the heat exchanger unit 2 acts as an evaporator, the confluence flow path 61*a* serves as a confluence flow path that merges refrigerant flowing from the air-downstream side heat transfer tubes 32 of the air-downstream side heat exchanger unit 31 and allows the refrigerant to flow to a refrigerant pipe (not illustrated).

This means that when the heat exchanger unit 2 acts as an evaporator, the heat exchanger 1 has the layered header 51 in which a distribution flow path (confluence flow path 51*a*) is formed, and the cylindrical header 61 in which a confluence flow path (confluence flow path 61*a*) is formed, separately.

Further, when the heat exchanger unit 2 acts as a condenser, the heat exchanger 1 has the cylindrical header 61 in which a distribution flow path (confluence flow path 61*a*) is formed, and the layered header 51 in which a confluence flow path (confluence flow path 51*a*) is formed, separately.

<Connection between Heat Exchanger Unit 2 and Confluence Unit 3>

Hereinafter, connection between the heat exchanger unit 2 and the confluence unit 3 of the heat exchanger 1 according to Embodiment 1 will be described.

As illustrated in FIGS. 2 and 3, a air-upstream side joint member 41 is joined to both one end 22*b* and the other end 22*c* of the substantially U-shaped air-upstream side heat transfer tube 22. The air-upstream side joint member 41 has a flow path formed therein. One end of the flow path has a shape extending along the outer peripheral face of the air-upstream side heat transfer tube 22, and the other end thereof is in a circular shape. Further, a air-downstream side joint member 42 is joined to both one end 32*b* and the other end 32*c* of the air-downstream side heat transfer tube 32 that is also formed in a substantially U shape. The air-downstream side joint member 42 has a flow path formed therein. One end of the flow path has a shape extending along the outer peripheral face of the air-downstream side heat transfer tube 32, and the other end thereof is in a circular shape.

The air-upstream side joint member 41 joined to the other end 22*c* of the air-upstream side heat transfer tube 22 and the air-downstream side joint member 42 joined to the one end 32*b* of the air-downstream side heat transfer tube 32 are connected by a row connecting pipe 43. The row connecting pipe 43 is a circular pipe bent in an arcuate shape, for example. To the air-upstream side joint member 41 joined to the one end 22*b* of the air-upstream side heat transfer tube 22, a connection pipe 57 of the layered header 51 is connected. To the air-downstream side joint member 42 joined to the other end 32*c* of the air-downstream side heat transfer tube 32, a connection pipe 64 of the cylindrical header 61 is connected.

It should be noted that the air-upstream side joint member 41 and the connection pipe 57 may be integrated. Further, the air-downstream side joint member 42 and the connection pipe 64 may be integrated. Furthermore, the air-upstream side joint member 41, the air-downstream side joint member 42, and the row connecting pipe 43 may be integrated.

Figure 4:
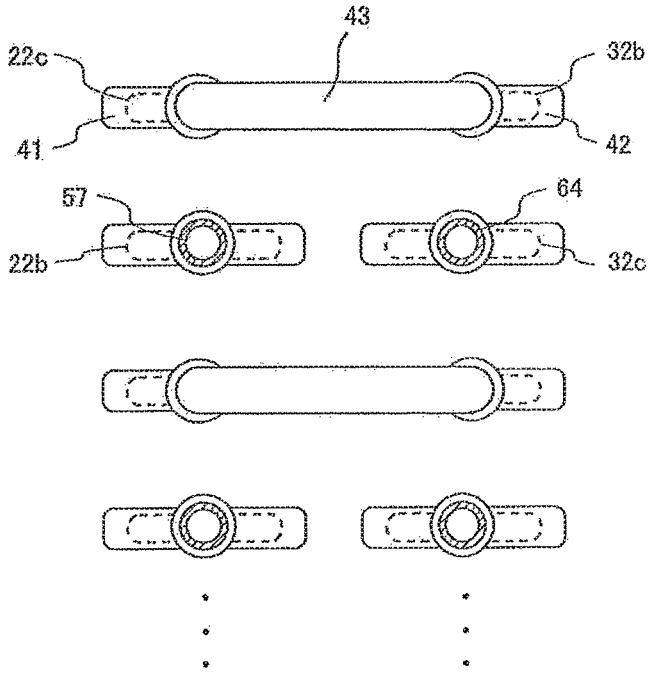
FIG. 4 illustrates connection between the heat exchanger unit 2 and the confluence unit 3 of a modification of the heat exchanger 1 according to Embodiment 1.

FIG. 4 illustrates connection between the heat exchanger unit 2 and the confluence unit 3 of a modification of the heat exchanger 1 according to Embodiment 1.

It should be noted that FIG. 4 is a cross-sectional view taken along a line A-A of FIG. 2.

As illustrated in FIG. 3, the air-upstream side heat transfer tube 22 and the air-downstream side heat transfer tube 32 may be disposed such that the one end 22*b* and the other end 22*c* of the air-upstream side heat transfer tube 22 and the one end 32*b* and the other end 32*c* of the air-downstream side heat transfer tube 32 are arranged in zigzag in a side view of the heat exchanger 1, or in a checkerboard pattern as illustrated in FIG. 4.

<Configuration of Air-Conditioning Apparatus 91 to Which Heat Exchanger 1 is Applied>

Hereinafter, a configuration of an air-conditioning apparatus 91, to which the heat exchanger 1 according to Embodiment 1 is applied, will be described.

Figure 5:
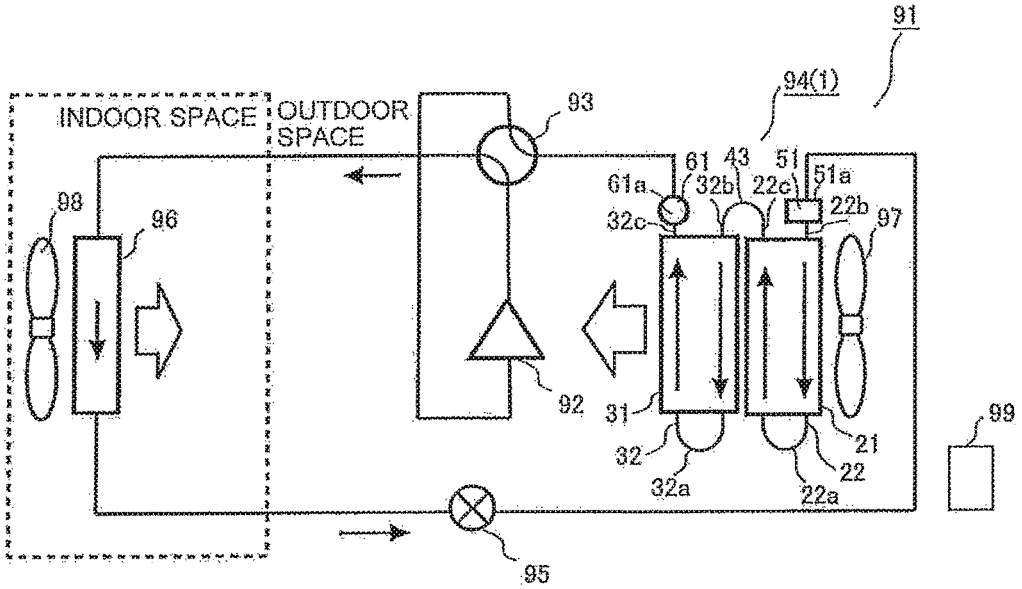
FIG. 5 is a diagram illustrating a configuration of an air-conditioning apparatus 91 to which the heat exchanger 1 according to Embodiment 1 is applied.
Figure 6:
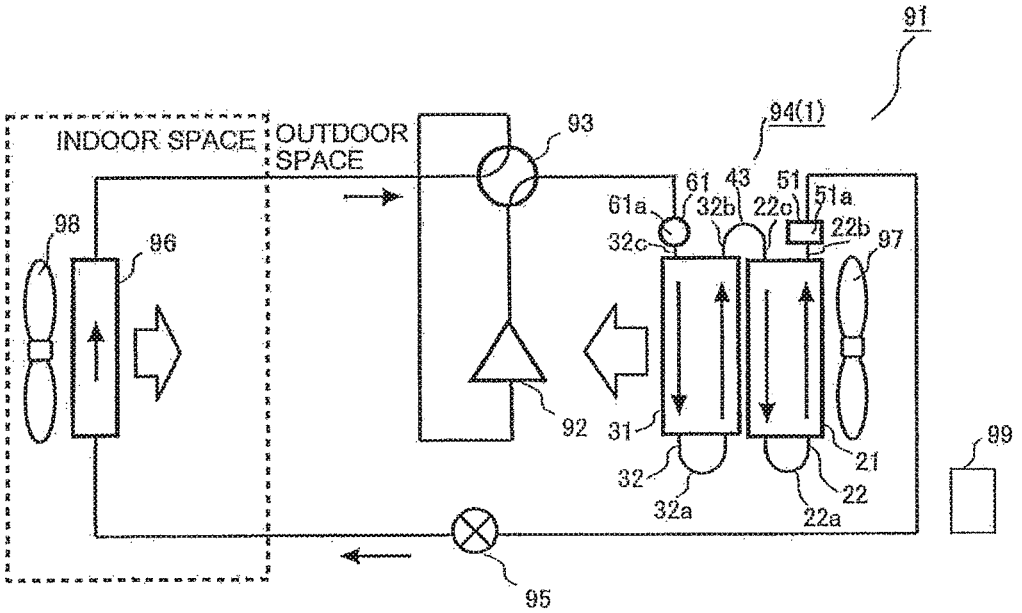
FIG. 6 is a diagram illustrating a configuration of an air-conditioning apparatus 91 to which the heat exchanger 1 according to Embodiment 1 is applied.

FIGS. 5 and 6 are diagrams illustrating a configuration of the air-conditioning apparatus 91 to which the heat exchanger 1 according to Embodiment 1 is applied. It should be noted that FIG. 5 illustrates the case where heating operation is performed in the air-conditioning apparatus 91. Further, FIG. 6 illustrates the case where cooling operation is performed in the air-conditioning apparatus 91.

As illustrated in FIGS. 5 and 6, the air-conditioning apparatus 91 includes a compressor 92, a four-way valve 93, an outdoor heat exchanger (heat source side heat exchanger) 94, an expansion device 95, an indoor heat exchanger (load side heat exchanger) 96, an outdoor fan (heat source side fan) 97, an indoor fan (load side fan) 98, and a controller 99. The compressor 92, the four-way valve 93, the outdoor heat exchanger 94, the expansion device 95, and the indoor heat exchanger 96 are connected with each other by refrigerant pipes to form a refrigerant cycle circuit. The four-way valve 93 may be another flow switching device.

The outdoor heat exchanger 94 is the heat exchanger 1. The heat exchanger 1 is provided such that the layered header 51 is positioned on the air-upstream side of the air flow generated when the outdoor fan 97 is driven, and that the cylindrical header 61 is positioned on the air-downstream side. The outdoor fan 97 may be provided on the air-upstream side of the heat exchanger 1 or on the air-downstream side of the heat exchanger 1.

The controller 99 is connected with the compressor 92, the four-way valve 93, the expansion device 95, the outdoor fan 97, the indoor fan 98, various sensors, and other devices, for example. When the flow path of the four-way valve 93 is switched by the controller 99, heating operation and cooling operation are switched from each other.

<Operation of Heat Exchanger 1 and Air-Conditioning Apparatus 91>

Hereinafter, operation of the heat exchanger 1 according to Embodiment 1 and the air-conditioning apparatus 91 to which the heat exchanger 1 is applied will be described.

(Operation of Heat Exchanger 1 and Air-Conditioning Apparatus 91 at the Time of Heating Operation)

Hereinafter, a flow of refrigerant at the time of heating operation will be described with use of FIG. 5.

High-pressure and high-temperature gas refrigerant, discharged from the compressor 92, flows into the indoor heat exchanger 96 via the four-way valve 93, and is condensed through heat exchange with the air supplied by the indoor fan 98 to thereby heat the room. The condensed refrigerant becomes a high-pressure subcooled liquid state, flows out of the indoor heat exchanger 96, and becomes refrigerant in a low-pressure two-phase gas-liquid state by the expansion device 95. The low-pressure two-phase gas-liquid refrigerant flows into the outdoor heat exchanger 94, exchanges heat with the air supplied by the outdoor fan 97, and is evaporated. The evaporated refrigerant becomes a low-pressure superheated gas state, flows out of the outdoor heat exchanger 94, and sucked by the compressor 92 via the four-way valve 93. This means that the outdoor heat exchanger 94 acts as an evaporator at the time of heating operation.

In the outdoor heat exchanger 94, the refrigerant flows into the confluence flow path 51*a* of the layered header 51 and is distributed, and flows into the one end 22*b* of the air-upstream side heat transfer tube 22 of the air-upstream side heat exchanger unit 21. The refrigerant flowing into the one end 22*b* of the air-upstream side heat transfer tube 22 passes through the folded portion 22*a*, flows to the other end 22*c* of the air-upstream side heat transfer tube 22, and flows into the one end 32*b* of the air-downstream side heat transfer tube 32 of the air-downstream side heat exchanger unit 31 via the row connecting pipe 43. The refrigerant flowing into the one end 32*b* of the air-downstream side heat transfer tube 32 passes through the folded portion 32*a*, flows to the other end 32*c* of the air-downstream side heat transfer tube 32, and flows into the confluence flow path 61*a* of the cylindrical header 61 and is merged.

(Operation of Heat Exchanger 1 and Air-Conditioning Apparatus 91 at the Time of Cooling Operation)

Hereinafter, a flow of refrigerant at the time of cooling operation will be described with use of FIG. 6.

High-pressure and high-temperature gas refrigerant, discharged from the compressor 92, flows into the outdoor heat exchanger 94 via the four-way valve 93, exchanges heat with the air supplied by the outdoor fan 97, and is condensed. The condensed refrigerant becomes a high-pressure subcooled liquid state (or low-quality two-phase gas-liquid state), flows out of the outdoor heat exchanger 94, and becomes a low-pressure two-phase gas-liquid state by the expansion device 95. The low-pressure refrigerant in a two-phase gas-liquid state flows into the indoor heat exchanger 96, exchanges heat with the air supplied by the indoor fan 98 and is evaporated to thereby cool the room. The evaporated refrigerant becomes a low-pressure superheated gas state, flows out of the indoor heat exchanger 96, and is sucked by the compressor 92 via the four-way valve 93. This means that the outdoor heat exchanger 94 acts as a condenser at the time of cooling operation.

In the outdoor heat exchanger 94, the refrigerant flows into the confluence flow path 61*a* of the cylindrical header 61 and is distributed, and flows into the other end 32*c* of the air-downstream side heat transfer tube 32 of the air-downstream side heat exchanger unit 31. The refrigerant flowing into the other end 32*c* of the air-downstream side heat transfer tube 32 passes through the folded portion 32*a* and flows to the one end 32*b* of the air-downstream side heat transfer tube 32, and flows into the other end 22*c* of the air-upstream side heat transfer tube 22 of the air-upstream side heat exchanger unit 21 via the row connecting pipe 43. The refrigerant flowing into the other end 22*c* of the air-upstream side heat transfer tube 22 passes through the folded portion 22*a* and flows to the one end 22*b* of the air-upstream side heat transfer tube 22, and flows into the confluence flow path 51*a* of the layered header 51 and is merged.

<Configuration of Layered Header 51>

Hereinafter, a configuration of the layered header 51 of the heat exchanger 1 according to Embodiment 1 will be described.

Figure 7:
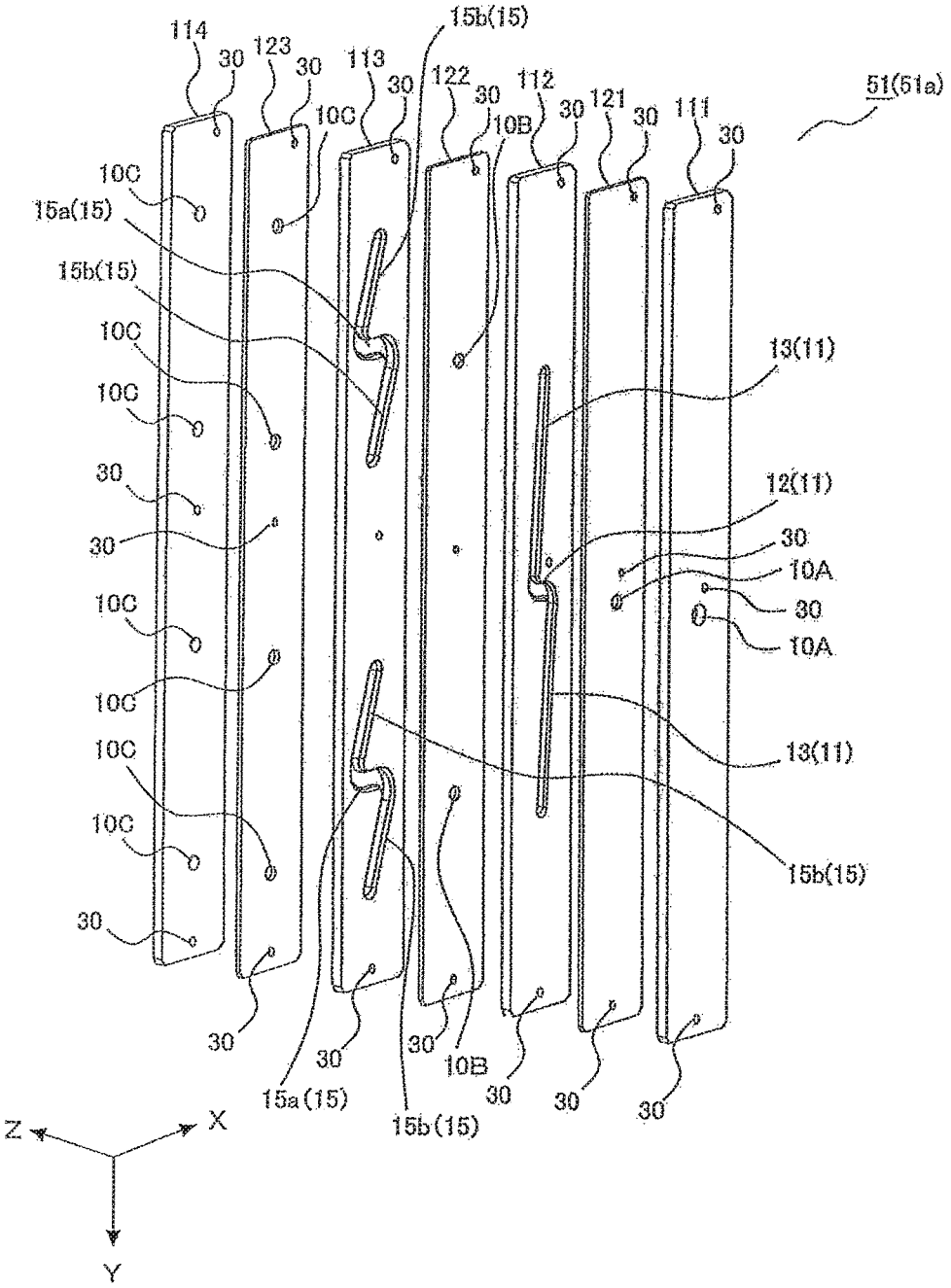
FIG. 7 is an exploded perspective view of a layered header 51 according to Embodiment 1.

FIG. 7 is an exploded perspective view of the layered header 51 according to Embodiment 1.

Figure 8:
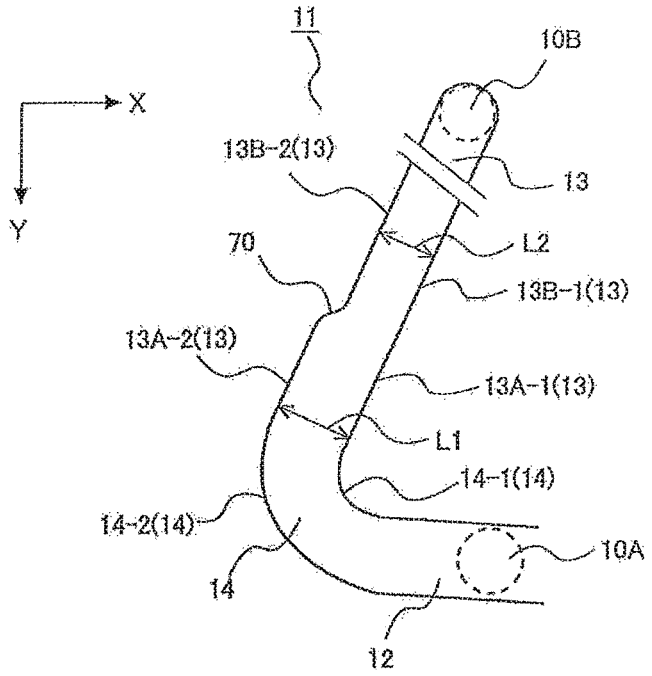
FIG. 8 is a partial enlarged view of a first branch flow path 11 in the layered header 51 according to Embodiment 1.

FIG. 8 is a partial enlarged view of the first branch flow path 11 in the layered header 51 according to Embodiment 1.

The layered header 51 (distributor) illustrated in FIG. 7 is configured of, for example, rectangular first plate bodies 111, 112, 113, and 114, and second plate bodies 121, 122, and 123 interposed between the respective first plate bodies. The first plate bodies 111, 112, 113, and 114 and the second plate bodies 121, 122, and 123 have the same external shape in a planer view.

To the first plate bodies 111, 112, 113, and 114 before braze joining, a brazing material is not clad (applied), while on both faces or an either face of the second plate bodies 121, 122, and 123, a brazing material is clad (applied). From this state, the first plate bodies 111, 112, 113, and 114 are layered via the second plate bodies 121, 122, and 123, and are heated and brazed in a furnace. The first plate bodies 111, 112, 113, and 114 and the second plate bodies 121, 122, 123 each are made of, for example, aluminum having a thickness of about 1 to 10 mm.

In the layered header 51, the confluence flow path 51*a* is configured of flow paths formed by the first plate bodies 111, 112, 113, and 114 and the second plate bodies 121, 122, and 123. The confluence flow path 51*a* includes a first flow path 10A, a second flow path 10B, and a third flow path 10C that are circular through holes, and the first branch flow path 11 and a second branch flow path 15 that are substantially S-shaped or substantially Z-shaped through grooves.

It should be noted that each of the plate bodies is processed by pressing or cutting. When it is processed by pressing, a plate material having a thickness of 5 mm or less capable of being processed by pressing is used. When it is processed by cutting, a plate material having a thickness of 5 mm or more may be used.

A refrigerant pipe of a refrigeration cycle device is connected to the first flow path 10A of the first plate body 111. The first flow path 10A of the first plate body 111 communicates with the connection pipe 52 of FIG. 1.

At almost the center of the first plate body 111 and the second plate body 121, the circular first flow path 10A is opened. Further, in the second plate body 122, a pair of second flow paths 10B is opened in a circular shape similarly at positions symmetrical with each other with respect to the first flow path 10A.

Furthermore, in the first plate body 114 and the second plate body 123, the third flow paths 10C are opened in a circular shape at four positions symmetrical with each other with respect to the second flow path 10B. The third flow path 10C of the first plate body 114 communicates with the air-upstream side heat transfer tube 22 of FIG. 1.

The first flow path 10A, the second flow path 10B, and the third flow path 10C are positioned and opened to communicate with each other when the first plate bodies 111, 112, 113, and 114 and the second plate bodies 121, 122, and 123 are layered.

Further, the first plate body 112 has the first branch flow path 11 that is a substantially S-shaped or substantially Z-shaped through groove, and the first plate body 113 has the second branch flow path 15 that is also a substantially S-shaped or substantially Z-shaped through groove.

Here, when the respective plate bodies are layered to form the confluence flow path 51*a*, the first flow path 10A is connected to the center of the first branch flow path 11 formed in the first plate body 112, and the second flow path 10B is connected to both ends of the first branch flow path 11.

Further, the second flow path 10B is connected to the center of the second branch flow path 15 formed in the first plate body 113, and the third flow path 10C is connected to both ends of the second branch flow path 15.

In this way, by layering and brazing the first plate bodies 111, 112, 113, and 114 and the second plate bodies 121, 122, and 123, the respective flow paths can be connected to form the confluence flow path 51*a*.

Further, each of the first plate bodies 111, 112, 113, and 114 and the second plate bodies 121, 122, and 123 has a positioning unit 30 for fixing the position when each plate member is layered.

Specifically, the positioning unit 30 is formed as a through hole, and positioning can be performed by inserting a pin into the through hole. It is also possible to have a configuration in which a recess is formed on one of plate members opposite to each other and a protrusion is formed on the other one, and the recess and the protrusion are fitted to each other when the two plate materials are layered.

(First Branch Flow Path 11)

Next, the structure of the first branch flow path 11 will be described in detail with use of FIG. 8.

As described above, the first branch flow path 11 is a substantially S-shaped or substantially Z-shaped through groove formed in the first plate body 112. The first branch flow path 11 is formed of a first communication flow path 12 extending in the short direction (X direction in FIG. 7) of the first plate body 112 and opened, and two second communication flow paths 13 extending from both ends of the first communication flow path 12 in the longitudinal direction (Y direction in FIG. 7) of the first plate body 112 and opened. The first communication flow path 12 and the second communication flow path 13 are connected smoothly by a bent portion 14. The second communication flow path 13 is configured of a base portion 13A connected to the bent portion 14, and a tip portion 13B extending from the base portion 13A in the longitudinal direction (Y direction in FIG. 7) of the first plate body 112.

The bent portion 14 is configured such that an inner peripheral wall portion 14-1 forming a side wall of the inner peripheral side and an outer peripheral wall portion 14-2 forming a side wall of the outer peripheral side are provided to face each other. The inner peripheral wall portion 14-1 and the outer peripheral wall portion 14-2 are configured as concentric circles, for example. It is configured that the radius of curvature of the inner peripheral wall portion 14-1 is smaller than the radius of curvature of the outer peripheral wall portion 14-2. The base portion 13A of the second communication flow path 13 is configured such that a base inner wall portion 13A-1 smoothly extending from the inner peripheral wall portion 14-1 of the bent portion 14 and a base outer wall portion 13A-2 smoothly extending from the outer peripheral wall portion 14-2 of the bent portion 14 are provided to face each other. Further, the tip portion 13B of the second communication flow path 13 is configured such that a tip inner wall portion 13B-1 connected on a straight line to the base inner wall portion 13A-1 of the base portion 13A, and a tip outer wall portion 13B-2 connected to the base outer wall portion 13A-2 of the base portion 13A, via a liquid film separation unit 70, are provided to face each other. In the first communication flow path 12, the bent portion 14, and the base portion 13A of the second communication flow path 13, a distance between side walls (the inner peripheral wall portion 14-1 and the outer peripheral wall portion 14-2, the base inner wall portion 13A-1 and the base outer wall portion 13A-2) facing each other has the same dimension L1. A distance (dimension L2) between side walls (the tip inner wall portion 13B-1 and the tip outer wall portion 13B-2) facing each other of the tip portion 13B is smaller than the dimension L1.

(Second Branch Flow Path 15)

Next, the structure of the second branch flow path 15 will be described.

As described above, the second branch flow path 15 is a substantially S-shaped or substantially Z-shaped through groove formed in the first plate body 113. The second branch flow path 15 is configured of a first communication flow path 15*a* extending in the short direction (X direction in FIG. 7) of the first plate body 113 and opened, and two second communication flow paths 15*b* extending from both ends of the first communication flow path 15*a* in the longitudinal direction (Y direction in FIG. 7) of the first plate body 113 and opened. The first communication flow path 15*a* and the second communication flow path 15*b* are smoothly connected by a bent portion.

(Liquid Film Separation Unit 70)

The form of the liquid film separation unit 70 will be described.

Figure 9:
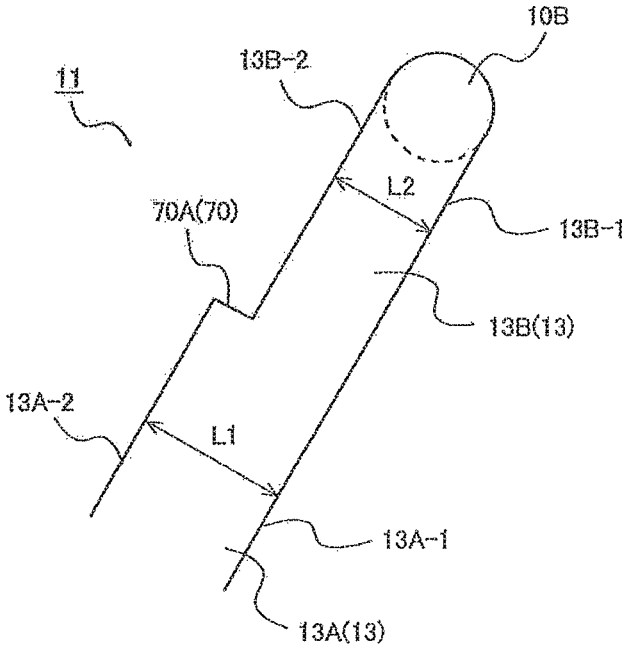
FIG. 9 is an enlarged view of the first branch flow path 11 according to Embodiment 1.

FIG. 9 is an enlarged view of the first branch flow path 11 according to Embodiment 1.

The liquid film separation unit 70 is formed between the base outer wall portion 13A-2 and the tip outer wall portion 13B-2 of the second communication flow path 13 in the first branch flow path 11. The liquid film separation unit 70 has a vertical portion 70A formed vertically with respect to the base outer wall portion 13A-2 and the tip outer wall portion 13B-2 of the second communication flow path 13.

<Flow of Refrigerant in Layered Header 51>

Next, the confluence flow path 51*a* in the layered header 51 and a flow of refrigerant therein will be described.

When the heat exchanger 1 functions as an evaporator, refrigerant in a two-phase gas-liquid flow flows from the first flow path 10A of the first plate body 111 into the layered header 51. The refrigerant flowing therein advances straight in the first flow path 10A, collides with the surface of the second plate body 122 in the first branch flow path 11 of the first plate body 112, and is divided horizontally in the first communication flow path 12.

The divided refrigerant advances to both ends of the first branch flow path 11 and flows into the pair of second flow paths 10B.

The refrigerant flowing in the second flow path 10B advances straight in the second flow path 10B in the same direction as the refrigerant advancing in the first flow path 10A. The refrigerant collides with the surface of the second plate body 123 in the second branch flow path 15 of the first plate body 113, and is divided horizontally in the first communication flow path 15*a*.

The divided refrigerant advances to both ends of the second branch flow path 15, and flows into four third flow paths 10C.

The refrigerant flowing in the third flow path 10C advances straight in the third flow path 10C in the same direction as the refrigerant advancing in the second flow path 10B.

Then, the refrigerant flows out of the third flow path 10C, and is uniformly divided and flows into the air-upstream side heat transfer tubes 22 of the air-upstream side heat exchanger unit 21.

It should be noted that while an example of the layered header 51 in which refrigerant flows branch flow paths twice and is divided into four in the confluence flow path 51*a* of Embodiment 1 is shown, the number of division is not limited particularly.

(Flow of Liquid Refrigerant in First Branch Flow Path 11)

Here, a flow of liquid refrigerant in the first branch flow path 11 will be described in more detail.

Figure 10:
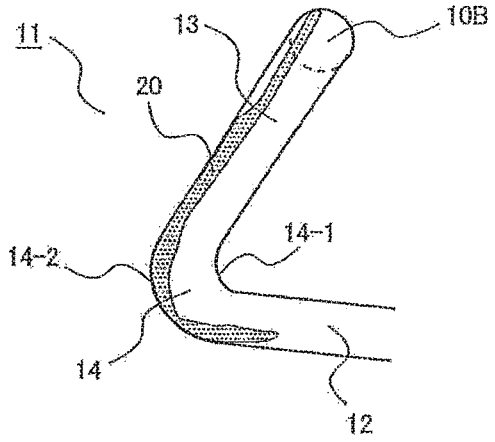
FIG. 10 Related Art
FIG. 10 illustrates a flow of liquid refrigerant in a branch flow path in a conventional layered header.

FIG. 10 illustrates a flow of liquid refrigerant in a branch flow path in a conventional layered header.

Figure 11:
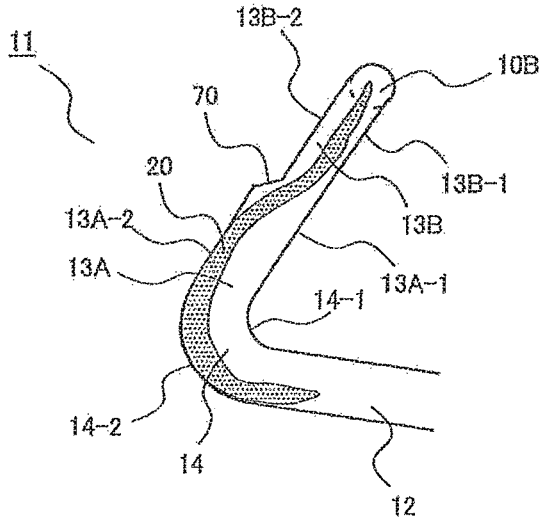
FIG. 11 illustrates a flow of liquid refrigerant in the first branch flow path 11 of the layered header 51 according to Embodiment 1.

FIG. 11 illustrates a flow of liquid refrigerant in the first branch flow path 11 in the layered header 51 according to Embodiment 1.

Conventionally, when liquid refrigerant flows in the first branch flow path 11 having the bent portion 14, a liquid film 20 is formed in a biased manner on the outer peripheral wall portion 14-2 side of the bent portion 14 by the centrifugal force, as illustrated in FIG. 10. The liquid film 20 flows through the second communication flow path 13 in a biased manner as it is, and flows into the second flow path 10B.

Meanwhile, in the first branch flow path according to Embodiment 1, the liquid film separation unit 70 is formed between the base outer wall portion 13A-2 and the tip outer wall portion 13B-2 of the second communication flow path 13, as illustrated in FIG. 11. The liquid film 20 flowing through the base portion 13A in a biased manner on the base outer wall portion 13A-2 side collides with the liquid film separation unit 70 and the flow path thereof is changed, whereby the liquid film 20 is separated from the base outer wall portion 13A-2 and flows through the center of the flow path in the tip portion 13B. Then, it flows into the second flow path 10B from substantially the center thereof.

<Effect>

According to the layered header 51 (distributor) of Embodiment 1, the liquid film separation unit 70 (vertical portion 70A) is formed between the base outer wall portion 13A-2 and the tip outer wall portion 13B-2 of the second communication flow path 13 in the first branch flow path 11. Accordingly, even though the liquid refrigerant flowing from the first flow path 10A flows in a biased manner on the outer peripheral wall portion 14-2 side of the bent portion 14 by the centrifugal force, when the liquid film of the liquid refrigerant flows from the base portion 13A into the tip portion 13B, it collides with the vertical portion 70A and is separated from the base outer wall portion 13A-2. Then, the flow path of the liquid refrigerant is changed to the tip inner wall portion 13B-1 side in the tip portion 13B, whereby the liquid refrigerant flows through the center of the tip portion 13B. The liquid refrigerant flows into the second flow path 10B from the center, and is uniformly distributed with respect to the flow path wall face. Therefore, at the next second branch flow path 15, the liquid refrigerant is uniformly distributed.

Accordingly, it is possible to uniformly supply the refrigerant at the flow path outlet (third flow path 10C) of the confluence flow path 51*a*. Thereby, it is possible to improve the heat exchange capacity of the heat exchanger and the air-conditioning apparatus.

Embodiment 2

In Embodiment 1, the liquid film separation unit 70 is formed as the vertical portion 70A. In Embodiment 2, the shape of the liquid film separation unit 70 differs from that of Embodiment 1. The other configurations are in common with the distributor, the layered header 51, the heat exchanger 1, and the air-conditioning apparatus 91 according to Embodiment 1. Therefore, the description thereof is omitted.

<Configuration of Liquid Film Separation Unit 70>

Figure 12:
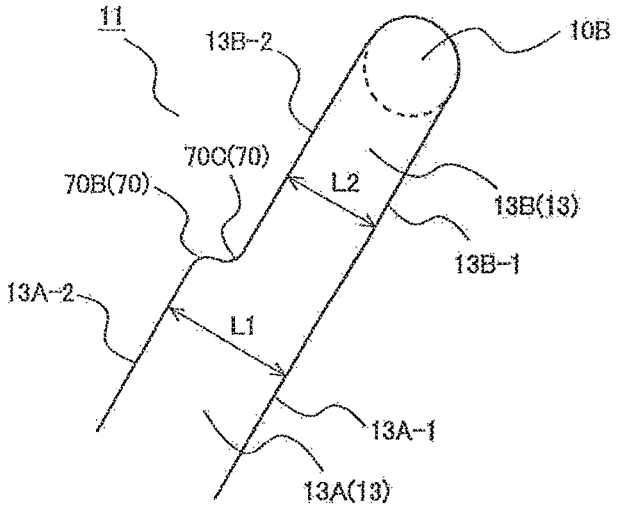
FIG. 12 is an enlarged view of a first branch flow path 11 according to Embodiment 2.

FIG. 12 is an enlarged view of the first branch flow path 11 according Embodiment 2.

The liquid film separation unit 70 is formed between the base outer wall portion 13A-2 and the tip outer wall portion 13B-2 of the second communication flow path 13 in the first branch flow path 11. The liquid film separation unit 70 is configured of a combination of two portions, namely a first arcuate portion 70B and a second arcuate portion 70C, connecting the base outer wall portion 13A-2 and the tip outer wall portion 13B-2 of the second communication flow path 13.

<Effect>

According to the layered header 51 (distributor) of Embodiment 2, the liquid film separation unit 70 (first arcuate portion 70B and second arcuate portion 70C) is formed between the base outer wall portion 13A-2 and the tip outer wall portion 13B-2 of the second communication flow path 13 in the first branch flow path 11. Accordingly, compared with the vertical portion 70A according to Embodiment 1, it is possible to separate the liquid film from the base outer wall portion 13A-2 more smoothly.

In that case, even though the liquid refrigerant flowing from the first flow path 10A flows in a biased manner on the outer peripheral wall portion 14-2 side of the bent portion 14 by the centrifugal force, the flow path of the liquid refrigerant is changed to the tip inner wall portion 13B-1 side in the tip portion 13B, whereby the liquid refrigerant flows through the center of the tip portion 13B. The liquid refrigerant flows into the second flow path 10B from the center, and is uniformly distributed with respect to the flow path wall face. Therefore, in the next second branch flow path 15, the liquid refrigerant is uniformly distributed.

Accordingly, it is possible to uniformly supply the refrigerant at the flow path outlet (third flow path 10C) of the confluence flow path 51*a*. Therefore, it is possible to improve the heat exchange capacity of the heat exchanger and the air-conditioning apparatus.

Further, by constituting the liquid film separation unit 70 of arcuate portions, it is possible to process the first plate body 112 by a drill or an end mill. Therefore, compared with the vertical portion 70A according to Embodiment 1, the time taken for finishing can be reduced, whereby the productivity is improved.

Embodiment 3

In Embodiment 1, the liquid film separation unit 70 is formed as the vertical portion 70A. In Embodiment 3, the shape of the liquid film separation unit 70 differs from that of Embodiment 1. The other configurations are in common with the distributor, the layered header 51, the heat exchanger 1, and the air-conditioning apparatus 91 according to Embodiment 1. Therefore, the description thereof is omitted.

<Configuration of Liquid Film Separation Unit 70>

Figure 13:
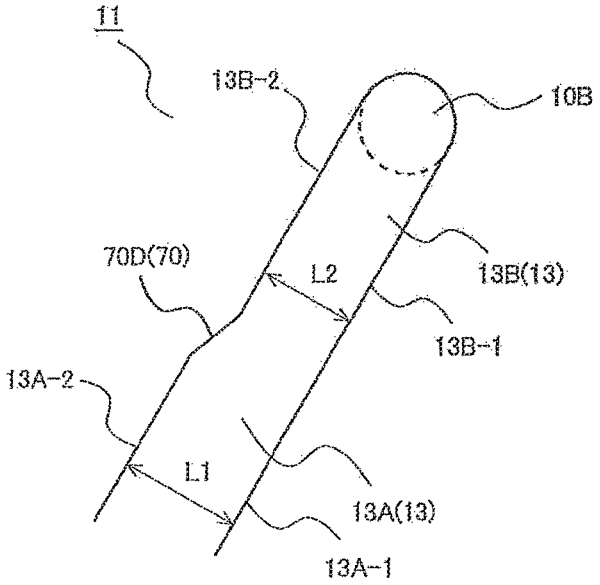
FIG. 13 is an enlarged view of a first branch flow path 11 according to Embodiment 3.

FIG. 13 is an enlarged view of the first branch flow path 11 according to Embodiment 3.

The liquid film separation unit 70 is formed between the base outer wall portion 13A-2 and the tip outer wall portion 13B-2 of the second communication flow path 13 in the first branch flow path 11. The liquid film separation unit 70 is configured of a tapered portion 70D having an inclination angle with respect to the base outer wall portion 13A-2 and the tip outer wall portion 13B-2 of the second communication flow path 13.

<Effect>

According to the layered header 51 (distributor) of Embodiment 3, the liquid film separation unit 70 (tapered portion 70D) is formed between the base outer wall portion 13A-2 and the tip outer wall portion 13B-2 of the second communication flow path 13 in the first branch flow path 11. Accordingly, compared with the vertical portion 70A according to Embodiment 1, it is possible to separate the liquid film from the base outer wall portion 13A-2 more smoothly.

In that case, even though the liquid refrigerant flowing from the first flow path 10A flows in a biased manner on the outer peripheral wall portion 14-2 side of the bent portion 14 by the centrifugal force, the flow path of the liquid refrigerant is changed to the tip inner wall portion 13B-1 side in the tip portion 13B, whereby the liquid refrigerant flows through the center of the tip portion 13B. The liquid refrigerant flows into the second flow path 10B from the center, and is uniformly distributed with respect to the flow path wall face. Therefore, in the next second branch flow path 15, the liquid refrigerant is uniformly distributed.

Accordingly, it is possible to uniformly supply the refrigerant at the flow path outlet (third flow path 10C) of the confluence flow path 51*a*. Therefore, it is possible to improve the heat exchange capacity of the heat exchanger and the air-conditioning apparatus.

Embodiment 4

In Embodiment 1, the liquid film separation unit 70 is formed as the vertical portion 70A. In Embodiment 4, the shape of the liquid film separation unit 70 differs from that of Embodiment 1. The other configurations are in common with the distributor, the layered header 51, the heat exchanger 1, and the air-conditioning apparatus 91 according to Embodiment 1. Therefore, the description thereof is omitted.

<Configuration of Liquid Film Separation Unit 70>

Figure 14:
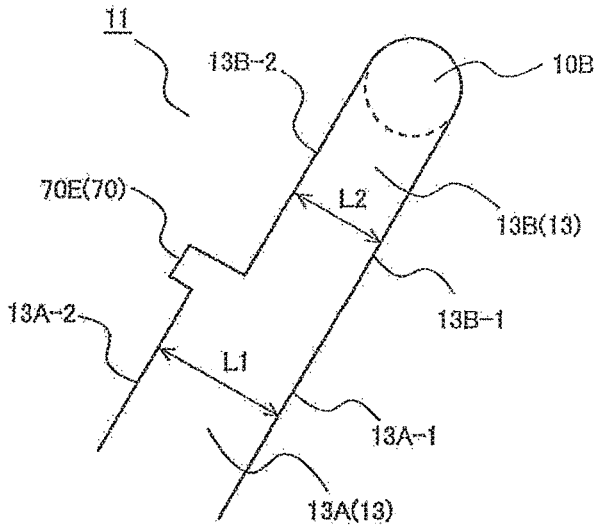
FIG. 14 is an enlarged view of a first branch flow path 11 according to Embodiment 4.

FIG. 14 is an enlarged view of the first branch flow path 11 according to Embodiment 4.

The liquid film separation unit 70 is formed between the base outer wall portion 13A-2 and the tip outer wall portion 13B-2 of the second communication flow path 13 in the first branch flow path 11. The liquid film separation unit 70 is configured as a rectangular recess portion 70E dented in a rectangular shape with respect to the wall face of the base outer wall portion 13A-2 of the second communication flow path 13.

<Effect>

According to the layered header 51 (distributor) of Embodiment 4, the liquid film separation unit 70 (rectangular recess portion 70E) is formed between the base outer wall portion 13A-2 and the tip outer wall portion 13B-2 of the second communication flow path 13 in the first branch flow path 11. Accordingly, compared with the vertical portion 70A according to Embodiment 1, it is possible to separate the liquid film from the base outer wall portion 13A-2 more effectively.

In that case, even though the liquid refrigerant flowing from the first flow path 10A flows in a biased manner on the outer peripheral wall portion 14-2 side of the bent portion 14 by the centrifugal force, the flow path of the liquid refrigerant is changed to the tip inner wall portion 13B-1 side in the tip portion 13B, whereby the liquid refrigerant flows through the center of the tip portion 13B. The liquid refrigerant flows into the second flow path 10B from the center, and is uniformly distributed with respect to the flow path wall face. Therefore, in the next second branch flow path 15, the liquid refrigerant is uniformly distributed.

Accordingly, it is possible to uniformly supply the refrigerant at the flow path outlet (third flow path 10C) of the confluence flow path 51*a*. Therefore, it is possible to improve the heat exchange capacity of the heat exchanger and the air-conditioning apparatus.

Embodiment 5

In Embodiment 1, the liquid film separation unit 70 is formed as the vertical portion 70A. In Embodiment 5, the shape of the liquid film separation unit 70 differs from that of Embodiment 1. The other configurations are in common with the distributor, the layered header 51, the heat exchanger 1, and the air-conditioning apparatus 91 according to Embodiment 1. Therefore, the description thereof is omitted.

<Configuration of Liquid Film Separation Unit 70>

Figure 15:
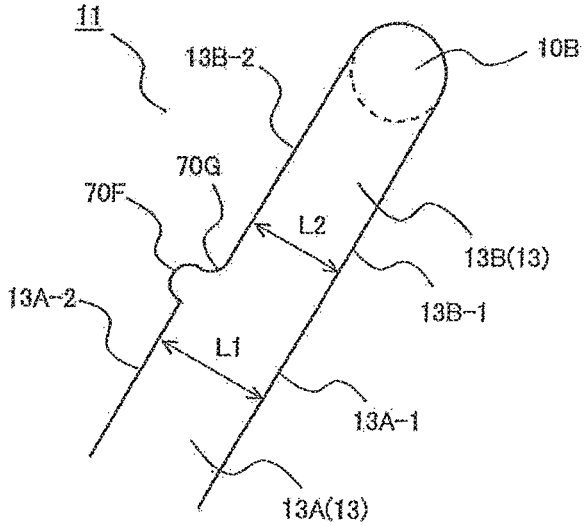
FIG. 15 is an enlarged view of a first branch flow path 11 according to Embodiment 5.

FIG. 15 is an enlarged view of the first branch flow path 11 according to Embodiment 5.

The liquid film separation unit 70 is formed between the base outer wall portion 13A-2 and the tip outer wall portion 13B-2 of the second communication flow path 13 in the first branch flow path 11. The liquid film separation unit 70 is configured as a circular recess portion 70F dented in a circular shape with respect to the wall face of the base outer wall portion 13A-2 of the second communication flow path 13. Further, the tip outer wall portion 13B-2 and the circular recess portion 70F are smoothly connected by a curved portion 70G.

<Effect>

According to the layered header 51 (distributor) of Embodiment 5, the liquid film separation unit 70 (circular recess portion 70F and curved portion 70G) is formed between the base outer wall portion 13A-2 and the tip outer wall portion 13B-2 of the second communication flow path 13 in the first branch flow path 11. Accordingly, compared with the vertical portion 70A according to Embodiment 1, it is possible to separate the liquid film from the base outer wall portion 13A-2 more effectively.

In that case, even though the liquid refrigerant flowing from the first flow path 10A flows in a biased manner on the outer peripheral wall portion 14-2 side of the bent portion 14 by the centrifugal force, the flow path of the liquid refrigerant is changed to the tip inner wall portion 13B-1 side in the tip portion 13B, whereby the liquid refrigerant flows through the center of the tip portion 13B. The liquid refrigerant flows into the second flow path 10B from the center, and is uniformly distributed with respect to the flow path wall face. Therefore, in the next second branch flow path 15, the liquid refrigerant is uniformly distributed.

Accordingly, it is possible to uniformly supply the refrigerant at the flow path outlet (third flow path 10C) of the confluence flow path 51*a*. Therefore, it is possible to improve the heat exchange capacity of the heat exchanger and the air-conditioning apparatus.

Embodiment 6

In Embodiment 1, the liquid film separation unit 70 is formed as the vertical portion 70A. In Embodiment 6, the shape of the liquid film separation unit 70 differs from that of Embodiment 1. The other configurations are in common with the distributor, the layered header 51, the heat exchanger 1, and the air-conditioning apparatus 91 according to Embodiment 1. Therefore, the description thereof is omitted.

<Configuration of Liquid Film Separation Unit 70>

Figure 16:
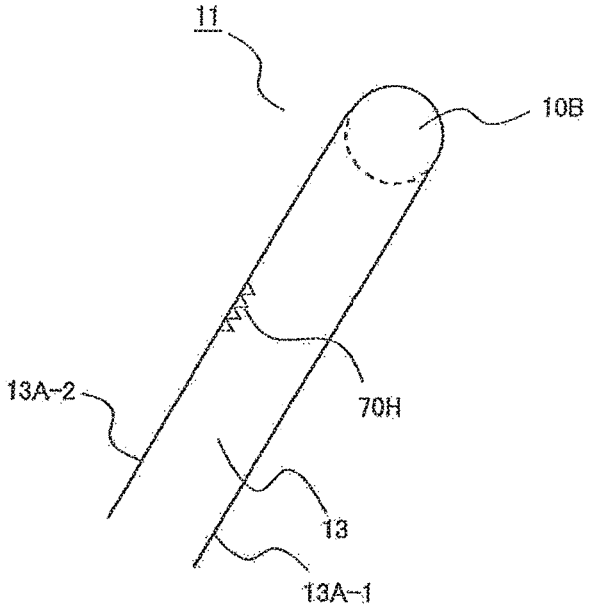
FIG. 16 is an enlarged view of a first branch flow path 11 according to Embodiment 6.

FIG. 16 is an enlarged view of the first branch flow path 11 according to Embodiment 6.

The liquid film separation unit 70 is formed between the base outer wall portion 13A-2 and the tip outer wall portion 13B-2 of the second communication flow path 13 in the first branch flow path 11. The liquid film separation unit 70 is configured as an uneven portion 70H having a surface roughness that is coarser than that of the wall face of the base outer wall portion 13A-2 of the second communication flow path 13. It should be noted that in Embodiment 6, the dimension L1 and the dimension L2 of the distances between opposite side walls in the base portion 13A and the tip portion 13B are the same length in the second communication flow path 13.

<Effect>

According to the layered header 51 (distributor) of Embodiment 6, the liquid film separation unit 70 (uneven portion 70H) is formed on the base outer wall portion 13A-2 of the second communication flow path 13 in the first branch flow path 11. Accordingly, compared with the vertical portion 70A according to Embodiment 1, it is possible to separate the liquid film from the base outer wall portion 13A-2 with a simpler configuration.

In that case, even though the liquid refrigerant flowing from the first flow path 10A flows in a biased manner on the outer peripheral wall portion 14-2 side of the bent portion 14 by the centrifugal force, the flow path of the liquid refrigerant is changed to the tip inner wall portion 13B-1 side in the tip portion 13B, whereby the liquid refrigerant flows through the center of the tip portion 13B. The liquid refrigerant flows into the second flow path 10B from the center, and is uniformly distributed with respect to the flow path wall face. Therefore, in the next second branch flow path 15, the liquid refrigerant is uniformly distributed.

Accordingly, it is possible to uniformly supply the refrigerant at the flow path outlet (third flow path 10C) of the confluence flow path 51*a*. Therefore, it is possible to improve the heat exchange capacity of the heat exchanger and the air-conditioning apparatus.

Embodiment 7

In a layered header 251 (distributor) according to Embodiment 7, a configuration of a confluence flow path 251*a* differs from the configuration of the confluence flow path 51*a* according to Embodiment 1. Accordingly, the configuration of the confluence flow path 251*a* will be described. The other configurations are in common with the distributor, the layered header, the heat exchanger, and the air-conditioning apparatus according to Embodiment 1.

<Configuration of Layered Header 251>

Hereinafter, a configuration of the layered header 251 of the heat exchanger 1 according to Embodiment 7 will be described.

Figure 17:
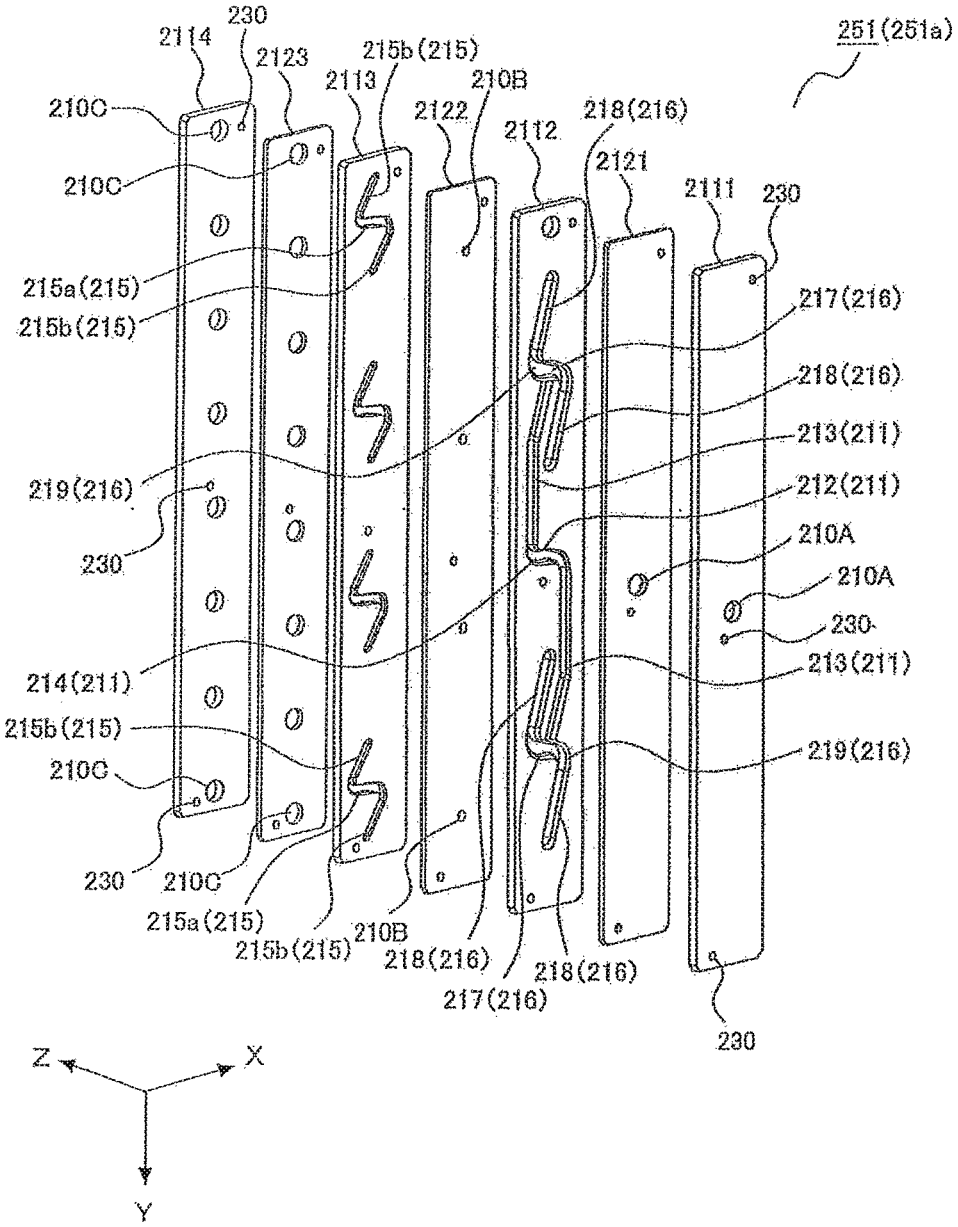
FIG. 17 is an exploded perspective view of a layered header 251 according to Embodiment 7.

FIG. 17 is an exploded perspective view of the layered header 251 according to Embodiment 7.

Figure 18:
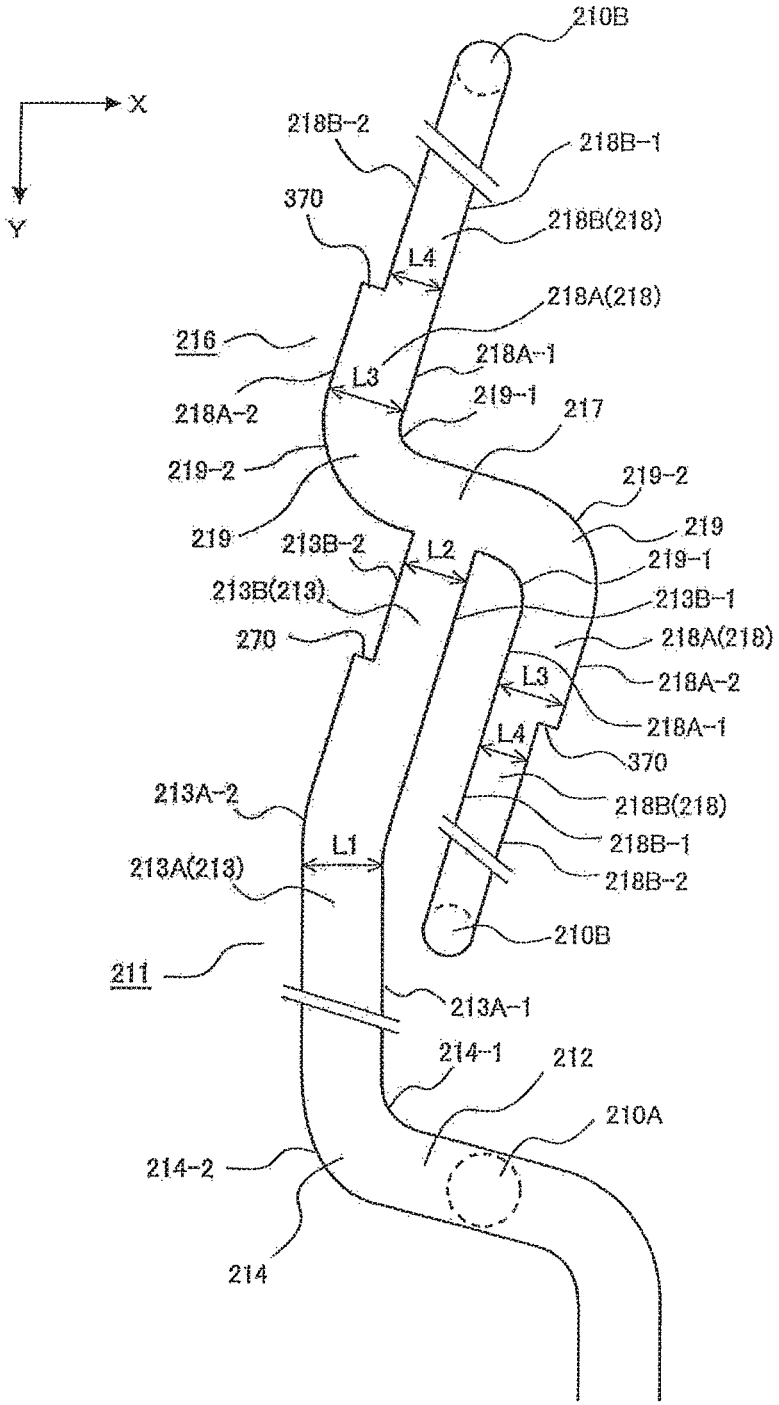
FIG. 18 is a partial enlarged view of a first branch flow path 211 in the layered header 251 according to Embodiment 7.

FIG. 18 is a partial enlarged view of the first branch flow path 211 in the layered header 251 according to Embodiment 7.

The layered header 251 (distributor) illustrated in FIG. 17 is configured of, for example, rectangular first plate bodies 2111, 2112, 2113, and 2114, and second plate bodies 2121, 2122, and 2123 interposed between the respective first plate bodies. The first plate bodies 2111, 2112, 2113, and 2114 and the second plate bodies 2121, 2122, and 2123 have the same external shape in a planer view.

To the first plate bodies 2111, 2112, 2113, and 2114 before braze joining, a brazing material is not clad (applied), while on both faces or an either face of the second plate bodies 2121, 2122, and 2123, a brazing material is clad (applied). From this state, the first plate bodies 2111, 2112, 2113, and 2114 are layered via the second plate bodies 2121, 2122, and 2123, and are heated and brazed in a furnace. Each of the first plate bodies 2111, 2112, 2113, and 2114 and the second plate bodies 2121, 2122, 2123 are made of aluminum having a thickness of about 1 to 10 mm, for example.

In the layered header 251, the confluence flow path 251*a* is configured of the flow paths formed by the first plate bodies 2111, 2112, 2113, and 2114 and the second plate bodies 2121, 2122, and 2123. The confluence flow path 251*a* includes a first flow path 210A, a second flow path 210B, and a third flow path 210C that are circular through holes, and a first branch flow path 211 and a second branch flow path 216 that are substantially S-shaped or substantially Z-shaped through grooves.

It should be noted that each of the plate bodies is processed by pressing or cutting. When it is processed by pressing, a plate material having a thickness of 5 mm or less capable of being processed by pressing is used. When it is processed by cutting, a plate material having a thickness of 5 mm or more may be used.

A refrigerant pipe of a refrigeration cycle device is connected to the first flow path 210A of the first plate body 2111. The first flow path 210A of the first plate body 2111 communicates with the connection pipe 52 of FIG. 1.

At almost the center of the first plate body 2111 and the second plate body 2121, the circular first flow path 210A is opened. Further, in the second plate body 2122, second flow paths 210B are opened, in a circular shape similarly, at four positions symmetrical with each other with respect to the first flow path 210A.

Furthermore, in the first plate body 2114 and the second plate body 2123, the third flow paths 210C are opened in a circular shape at eight positions symmetrical with each other with respect to the second flow path 210B. The third flow path 210C of the first plate body 2114 communicates with the air-upstream side heat transfer tube 22 of FIG. 1.

The first flow path 210A, the second flow path 210B, and the third flow path 210C are positioned and opened to communicate with each other when the first plate bodies 2111, 2112, 2113, and 2114 and the second plate bodies 2121, 2122, and 2123 are layered.

The first plate body 2112 has the first branch flow path 211 and the second branch flow path 216 each of which is a substantially S-shaped or substantially Z-shaped through groove, and the first plate body 2113 has a third branch flow path 215 that is also a substantially S-shaped or substantially Z-shaped through groove.

Here, when the respective plate bodies are layered to form the confluence flow path 251*a*, the first flow path 210A is connected to the center of the first branch flow path 11 formed in the first plate body 2112, and the second branch flow path 216 is connected to both ends of the first branch flow path 211.

Then, the second flow path 210B is connected to both ends of the second branch flow path 216.

Further, the second flow path 210B is connected to the center of the third branch flow path 215 formed in the first plate body 113, and the third flow path 210C is connected to both ends of the third branch flow path 215.

In this way, by layering and brazing the first plate bodies 2111, 2112, 2113, and 2114 and the second plate bodies 2121, 2122, and 2123, the respective flow paths can be connected to form the confluence flow path 251*a*.

Further, each of the first plate bodies 2111, 2112, 2113, and 2114 and the second plate bodies 2121, 2122, and 2123 has a positioning unit 230 for fixing the position when each plate body is layered.

Specifically, the positioning unit 230 is formed as a through hole, and positioning can be performed by inserting a pin into the through hole. It is also possible to have a configuration in which a recess is formed on one of plate members opposite to each other and a protrusion is formed on the other one, and the recess and the protrusion are fitted to each other when the two plate materials are layered.

(First Branch Flow Path 211)

Next, the structure of the first branch flow path 211 will be described in detail with use of FIG. 18.

As described above, the first branch flow path 211 is a substantially S-shaped or substantially Z-shaped through groove formed in the first plate body 2112. The first branch flow path 211 is formed of a first communication flow path 212 extending in the short direction (X direction in FIG. 7) of the first plate body 2112 and opened, and two second communication flow paths 213 extending from both ends of the first communication flow path 212 in the longitudinal direction (Y direction in FIG. 7) of the first plate body 2112 and opened. The first communication flow path 212 and the second communication flow path 213 are connected smoothly by a bent portion 214. The second communication flow path 213 is configured of a base portion 213A connected to the bent portion 214, and a tip portion 213B extending from the base portion 213A in the longitudinal direction (Y direction in FIG. 7) of the first plate body 2112.

The bent portion 214 is configured such that an inner peripheral wall portion 214-1 forming a side wall of the inner peripheral side and an outer peripheral wall portion 214-2 forming a side wall of the outer peripheral side are provided to face each other. The inner peripheral wall portion 214-1 and the outer peripheral wall portion 214-2 are configured to form concentric circles, for example. It is configured that the radius of curvature of the inner peripheral wall portion 214-1 is smaller than the radius of curvature of the outer peripheral wall portion 214-2. The base portion 213A of the second communication flow path 213 is configured such that a base inner wall portion 213A-1 smoothly extending from the inner peripheral wall portion 214-1 of the bent portion 214 and a base outer wall portion 213A-2 smoothly extending from the outer peripheral wall portion 214-2 of the bent portion 214 are provided to face each other. Further, the tip portion 2138 of the second communication flow path 213 is configured such that a tip inner wall portion 213B-1 connected on a straight line to the base inner wall portion 213A-1 of the base portion 213A, and a tip outer wall portion 213B-2 connected to the base outer wall portion 213A-2 of the base portion 213A, via a liquid film separation unit 270, are provided to face each other. In the first communication flow path 212, the bent portion 214, and the base portion 213A of the second communication flow path 213, a distance between side walls (the inner peripheral wall portion 214-1 and the outer peripheral wall portion 214-2, the base inner wall portion 213A-1 and the base outer wall portion 213A-2) facing each other has the same dimension L1. A distance (dimension L2) between side walls (the tip inner wall portion 213B-1 and the tip outer wall portion 213B-2) facing each other of the tip portion 2138 is shorter than the dimension L1.

(Second Branch Flow Path 216)

Next, the structure of the second branch flow path 216 will be described in detail with use of FIG. 18.

The second branch flow path 216 is a substantially S-shaped or substantially Z-shaped through groove formed in the first plate body 2112, as described above. The second branch flow path 216 is configured of a first communication flow path 217 extending in the short direction (X direction in FIG. 17) of the first plate body 2112 and opened, and two second communication flow paths 218 extending from both ends of the first communication flow path 217 in the longitudinal direction (Y direction in FIG. 17) of the first plate body 2112 and opened.

Both ends of the first branch flow path 211 are connected to the center of the first communication flow path 217 of the second branch flow path 216.

The first communication flow path 217 and the second communication flow path 218 are smoothly connected to each other via the bent portion 219. The second communication flow path 218 is configured of a base portion 218A connected to the bent portion 219, and a tip portion 218B extending from the base portion 218A in the longitudinal direction (Y direction in FIG. 17) of the first plate body 2112.

The bent portion 219 is configured such that an inner peripheral wall portion 219-1 forming a side wall of the inner peripheral side and an outer peripheral wall portion 219-2 forming a side wall of the outer peripheral side are provided to face each other. The inner peripheral wall portion 219-1 and the outer peripheral wall portion 219-2 are configured to form concentric circles, for example. It is configured that the radius of curvature of the inner peripheral wall portion 219-1 is smaller than the radius of curvature of the outer peripheral wall portion 219-2. The base portion 218A of the second communication flow path 218 is configured such that a base inner wall portion 218A-1 smoothly extending from the inner peripheral wall portion 219-1 of the bent portion 219 and a base outer wall portion 218A-2 smoothly extending from the outer peripheral wall portion 219-2 of the bent portion 219 are provided to face each other. Further, the tip portion 218B of the second communication flow path 218 is configured such that a tip inner wall portion 218B-1 connected on a straight line to the base inner wall portion 218A-1 of the base portion 218A, and a tip outer wall portion 218B-2 connected to the base outer wall portion 218A-2 of the base portion 218A, via a liquid film separation unit 370, are provided to face each other. In the first communication flow path 217, the bent portion 219, and the base portion 218A of the second communication flow path 218, a distance between side walls (the inner peripheral wall portion 219-1 and the outer peripheral wall portion 219-2, the base inner wall portion 218A-1 and the base outer wall portion 218A-2) facing each other has the same dimension L3. A distance (dimension L4) between side walls (the tip inner wall portion 218B-1 and the tip outer wall portion 218B-2) facing each other of the tip portion 218B is shorter than the dimension L3.

(Third Branch Flow Path 215)

Next, the structure of the third branch flow path 215 will be described.

The third branch flow path 215 is a substantially S-shaped or substantially Z-shaped through groove formed in the first plate body 2113 as described above. The third branch flow path 215 is configured of a first communication flow path 215*a* extending in the short direction (X direction in FIG. 17) of the first plate body 2113 and opened, and two second communication flow paths 215*b* extending from both ends of the first communication flow path 215*a* in the longitudinal direction (Y direction in FIG. 17) of the first plate body 2113 and opened. The first communication flow path 215*a* and the second communication flow path 215*b* are smoothly connected to each other via a bent portion.

(Liquid Film Separation Unit 270, 370)

The form of the liquid film separation units 270 and 370 will be described.

The liquid film separation unit 270 is formed between the base outer wall portion 213A-2 and the tip outer wall portion 213B-2 of the second communication flow path 213 in the first branch flow path 211. Further, the liquid film separation unit 370 is formed between the base outer wall portion 218A-2 and the tip outer wall portion 218B-2 of the second communication flow path 218 in the second branch flow path 216.

The liquid film separation units 270 and 370 may adopt the forms similar to those of Embodiments 1 to 6.

<Flow of Refrigerant in Layered Header 251>

Next, the confluence flow path 251*a* in the layered header 251 and a flow of refrigerant therein will be described.

When the heat exchanger 1 functions as an evaporator, refrigerant in a two-phase gas-liquid flow flows from the first flow path 210A of the first plate body 2111 into the layered header 251. The refrigerant flowing therein advances straight in the first flow path 210A, collides with the surface of the second plate body 2122 in the first branch flow path 211 of the first plate body 2112, and is divided horizontally in the first communication flow path 212.

The divided refrigerant advances to both ends of the first branch flow path 211 and flows into the second branch flow path 216. The refrigerant flowing in the second branch flow path 216 is divided horizontally in the first communication flow path 217 and advances to both ends of the second branch flow path 216. Then, the refrigerant flows into the four second flow paths 210B.

The refrigerant flowing in the second flow path 210B advances straight in the second flow path 210B in the same direction as the refrigerant advancing in the first flow path 210A. The refrigerant collides with the surface of the second plate body 2123 in the third branch flow path 215 of the first plate body 2113, and is further divided horizontally in the first communication flow path 215*a*.

The divided refrigerant advances to both ends of the third branch flow path 215, and flows into the eight third flow paths 210C.

The refrigerant flowing in the third flow path 210C advances straight in the third flow path 210C in the same direction as the refrigerant advancing in the second flow path 210B.

Then, the refrigerant flows out of the third flow path 210C, and is uniformly divided and flows into the air-upstream side heat transfer tubes 22 of the air-upstream side heat exchanger unit 21.

It should be noted that while an example in which the refrigerant flows branch flow paths twice and is divided into eight in the layered header 251 is shown in the confluence flow path 251*a* of Embodiment 7, the number of division is not limited particularly.

(Flow of Liquid Refrigerant in First Branch Flow Path 211 and Second Branch Flow Path 216)

Here, a flow of liquid refrigerant in the first branch flow path 211 and the second branch flow path 216 will be described in more detail.

As illustrated in FIG. 18, in the first branch flow path 211 according to Embodiment 7, the liquid film separation unit 270 is formed between the base outer wall portion 213A-2 and the tip outer wall portion 213B-2 of the second communication flow path 213. The liquid film flowing through the base portion 213A in a biased manner on the base outer wall portion 213A-2 side collides with the liquid film separation unit 270 and the flow path thereof is changed, whereby the liquid film is separated from the base outer wall portion 213A-2 and flows through the center of the flow path in the tip portion 213B. Then, it flows into the second branch flow path 216 with no bias of the liquid film.

Further, as illustrated in FIG. 18, in the second branch flow path 216, the liquid film separation unit 370 is formed between the base outer wall portion 218A-2 and the tip outer wall portion 218B-2 of the second communication flow path 218. The liquid film flowing through the base portion 218A in a biased manner on the base outer wall portion 218A-2 side collides with the liquid film separation unit 370 and the flow path thereof is changed, whereby the liquid film is separated from the base outer wall portion 218A-2 and flows through the center of the flow path in the tip portion 218B. Then, it flows into the second flow path 210B from the center with no bias of the liquid film.

<Effect>

According to the layered header 251 (distributor) of Embodiment 7, the liquid film separation unit 270 is formed between the base outer wall portion 213A-2 and the tip outer wall portion 213B-2 of the second communication flow path 213 in the first branch flow path 211. Therefore, even though the liquid refrigerant flowing from the first flow path 210A flows in a biased manner on the outer peripheral wall portion 214-2 side of the bent portion 214 by the centrifugal force, the liquid film of the liquid refrigerant collides with the liquid film separation unit 270 when flowing from the base portion 213A to the tip portion 213B, and is separated from the base outer wall portion 213A-2. In that case, the flow path of the liquid refrigerant is changed to the tip inner wall portion 213B-1 side in the tip portion 213B, and the liquid refrigerant flows through the center of the tip portion 213B. As the liquid refrigerant flows into the second branch flow path 216 with no bias of the liquid film, it is uniformly distributed in the first communication flow path 217.

Further, the liquid film separation unit 370 is formed between the base outer wall portion 218A-2 and the tip outer wall portion 218B-2 of the second communication flow path 218 in the second branch flow path 216. Therefore, even though the liquid refrigerant flowing from the first branch flow path 211 flows in a biased manner on the outer peripheral wall portion 219-2 side of the bent portion 219 by the centrifugal force, the liquid film of the liquid refrigerant collides with the liquid film separation unit 370 when flowing from the base portion 218A to the tip portion 218B, and is separated from the base outer wall portion 218A-2. In that case, the flow path of the liquid refrigerant is changed to the tip inner wall portion 218B-1 side in the tip portion 218B, and the liquid refrigerant flows through the center of the tip portion 218B. As the liquid refrigerant flows into the second flow path 10B from the center and is uniformly distributed with respect to the flow path wall, the liquid refrigerant is uniformly distributed in the next third branch flow path 215.

Accordingly, it is possible to uniformly supply the refrigerant at the flow path outlet (third flow path 210C) of the confluence flow path 251*a*, whereby it is possible to improve the heat exchange capacity of the heat exchanger 1 and the air-conditioning apparatus 91.

It should be noted that while Embodiment 7 illustrates an example in which the liquid film separation units 270 and 370 are provided on the two branch flow paths namely the first branch flow path 211 and the second branch flow path 216 respectively, it is possible to provide either one of the liquid film separation units 270 and 370. It is also possible to provide only the liquid film separation unit 370 of the second branch flow path 216 that highly affects uniform distribution of the liquid refrigerant in the third branch flow path 215.

Embodiments 1 to 7 illustrate examples in which the number of the first plate bodies and the second plate bodies interposed between the respective first plate bodies is seven in total. However, the number of the plate bodies is not limited particularly. Further, the number of divisions of the branch flow paths is not limited to those described in the embodiments.

Further, while, in Embodiments 1 to 7, the layered headers 51 and 251 are described as examples, the configurations of the liquid film separation units 70, 270, and 370 described in Embodiments 1 to 7 may be applicable to the flow paths of a distribution device or a distributor utilizing more general pipes.

<Effects of Present Invention>

(1) A distributor according to the present invention includes one first flow path 10A, 210A, and a first branch flow path 11, 211 for dividing the first flow path 10A, 210A into a plurality of second flow paths 10B, 210B. The first branch flow path 11, 211 is configured to include a first communication flow path 12, 212, 217 communicating with the first flow path 10A, 210A, a second communication flow path 13, 213, 218 communicating with each of the second flow paths 10B, 210B, and a bent portion 14, 214, 219 connecting the first communication flow path 12, 212, 217 and the second communication flow path 13, 213, 218. The bent portion 14, 214, 219 includes an inner peripheral wall portion 14-1, 214-1, 219-1 including an inner face having a first radius of curvature, and an outer peripheral wall portion 14-2, 214-2, 219-2 including an inner face having a second radius of curvature larger than the first radius of curvature. The second communication flow path 13, 213, 218 includes an inner wall portion extending from the inner peripheral wall portion 14-1, 214-1, 219-1 of the bent portion 14, 214, 219, and an outer wall portion extending from the outer peripheral wall portion 14-2, 214-2, 219-2 of the bent portion. In the outer wall portion, a liquid film separation unit 70, 270, 370 is formed.

As such, even though the liquid refrigerant flowing from the first flow path 10A, 210A flows in a biased manner on the outer peripheral side of the bent portion 14, 214, 219 by the centrifugal force, the liquid film of the liquid refrigerant collides with the liquid film separation unit 70, 270, 370 and is separated from the outer wall portion of the second communication flow path 13, 213, 218. The flow path of the liquid refrigerant is changed to the inner wall portion side of the second communication flow path 13, 213, 218, and the liquid refrigerant flows through the center of the flow path. Then, the liquid refrigerant flows into the second flow path 10B, 210B from the center and is uniformly distributed with respect to the flow path wall face, whereby the liquid refrigerant is uniformly distributed in the next branch flow path.

(2) The distributor according to the present invention includes a first flow path 210A, a first branch flow path 211 for dividing the first flow path 210A, and a plurality of second branch flow paths 216 for dividing the first branch flow path 211 into a second flow path 210B. The second branch flow path 216 is configured to include a first communication flow path 217 communicating with the first branch flow path 211, a second communication flow path 218 communicating, at one end side thereof, with the second flow path 210B, and a bent portion 219 connecting the first communication flow path 217 and the second communication flow path 218. The bent portion 219 includes an inner peripheral wall portion 219-1 including an inner face having a first radius of curvature, and an outer peripheral wall portion 219-2 including an inner face having a second radius of curvature larger than the first radius of curvature. The second communication flow path 218 includes an inner wall portion extending from the inner peripheral wall portion 219-1 of the bent portion 219, and an outer wall portion extending from the outer peripheral wall portion 219-2 of the bent portion 219. In the outer wall portion, the liquid film separation unit 370 is formed.

As such, even though the liquid refrigerant flowing from the first branch flow path 211 into the second branch flow path 216 flows in a biased manner on the outer peripheral side of the bent portion 219 by the centrifugal force, the liquid film of the liquid refrigerant collides with the liquid film separation unit 370 and is separated from the outer wall portion of the second communication flow path 218. The flow path of the liquid refrigerant is changed to the inner wall portion side of the second communication flow path 218, and the liquid refrigerant flows through the center of the flow path. Then, the liquid refrigerant flows into the second flow path 210B from the center and is uniformly distributed with respect to the flow path wall face, whereby the liquid refrigerant is uniformly distributed in the next branch flow path.

(3) The liquid film separation unit 70, 270, 370 of the distributor according to the present invention is formed as a protruding portion on the outer wall portion of the second communication flow path 13, 213, 218 in the distributor described in (1) or (2). Accordingly, the liquid film separation unit 70, 270, 370 serves as a flow path resistance against fluid to thereby be able to separate the liquid film from the outer wall portion.

(4) The liquid film separation unit 70, 270, 370 of the distributor according to the present invention is formed as a recess portion on the outer wall portion of the second communication flow path 13, 213, 218 in the distributor described in (1) or (2). Accordingly, the liquid film separation unit 70, 270, 370 serves as a flow path resistance against the fluid to thereby be able to separate the liquid film from the outer wall portion.

(5) The distributor according to the present invention is the distributor according to (1) to (4) in which a dimension between the inner wall portion and the outer wall portion of the second communication flow path 13, 213, 218 is configured such that one end side, that is, the bent portion 14, 214, 219 side, of the second communication flow path 13, 213, 218 is larger than the other end side of the second communication flow path 13, 213, 218, with the liquid film separation unit 70, 270, 370 being the boundary. Accordingly, the liquid film separation unit 70, 270, 370 is formed as a stepped portion and serves as a flow path resistance against the fluid to thereby be able to separate the liquid film from the outer wall portion.

(6) The distributor according to the present invention is the distributor according to (1) to (5) including one second flow path of a plurality of second flow paths and a third branch flow path connecting the one second flow path and a plurality of third flow paths. As such, when the liquid refrigerant flows into the third flow paths, the liquid refrigerant can be distributed uniformly.

(7) The layered header 51, 251 according to the present invention is configured of the distributor according to (1) to (6), in which at least a first plate body in which the first flow path 10A, 210A is opened, a second plate body in which the first branch flow path 11, 211 is opened, and a third plate body in which the second flow path 10B, 210B is opened, are layered integrally. Therefore, the distributor according to (1) to (6) can be configured as the layered header 51, 251, whereby a confluence flow path 51*a*, 251*a* of the distributor can be formed easily.

(8) The heat exchanger 1 according to the present invention includes the distributor according to (1) to (6) and a plurality of heat transfer tubes, in which the plurality of heat transfer tubes and the distributor are connected to each other. Therefore, it is possible to uniformly supply the liquid refrigerant to the respective heat transfer tubes of the heat exchanger 1, and to improve the heat conductive performance of the heat exchanger 1.

(9) The heat exchanger 1 according to the present invention includes the layered header 51, 251 according to (7) and a plurality of heat transfer tubes, in which the heat transfer tubes and the layered header 51, 251 are connected to each other. Therefore, it is possible to uniformly supply the liquid refrigerant to the respective heat transfer tubes of the heat exchanger 1, and to improve the heat conductive performance of the heat exchanger 1.

(10) The air-conditioning apparatus 91 according to the present invention includes the heat exchanger 1 according to (8) or (9). Therefore, as the heat conductive performance of the heat exchanger 1 is improved, the performance of the air-conditioning apparatus 91 can be improved.

The invention claimed is:

1. A distributor comprising:

a first flow path;

a plurality of second flow paths; and a first branch flow path for dividing the first flow path into the plurality of second flow paths, wherein the first branch flow path includes a first communication flow path communicating with the first flow path;

a second communication flow path communicating with each of the second flow paths; and a bent portion connecting the first communication flow path and the second communication flow path, the bent portion includes an inner peripheral wall portion including an inner face having a first radius of curvature, and an outer peripheral wall portion including an inner face having a second radius of curvature larger than the first radius of curvature, the second communication flow path includes an inner wall portion extending from the inner peripheral wall portion of the bent portion, and an outer wall portion extending from the outer peripheral wall portion of the bent portion, wherein the second communication flow path includes a base portion and a tip portion, and the base portion is located between the tip portion and the bent portion, the base portion and the tip portion have oppositely facing side walls, respectively, the distance between the oppositely facing side walls of the base portion is greater than the distance between the oppositely facing side walls of the tip portion, and the outer wall portion includes a liquid film separation unit that forms a boundary between the base portion and the tip portion.

2. The distributor of claim 1, wherein the liquid film separation unit is a protruding portion formed on the outer wall portion.

3. The distributor of claim 1, wherein the liquid film separation unit is a recess portion formed on the outer wall portion.

4. The distributor of claim 1, further comprising a third branch flow path connecting one of the second flow paths and a plurality of third flow paths.

5. The distributor of claim 1, wherein the distributor is included in a layered header, wherein at least a first plate body in which the first flow path is opened, a second plate body in which the first branch flow path is opened, and a third plate body in which the second flow path is opened are layered integrally.

6. The distributor of claim 1, wherein the distributor is included in a heat exchanger that includes a plurality of heat transfer tubes, wherein the heat transfer tubes and the distributor are connected to each other.

7. The distributor of claim 5, wherein the distributor is included in a heat exchanger that includes the layered header and a plurality of heat transfer tubes, wherein the heat transfer tubes and the layered header are connected to each other.

8. The distributor of claim 6, wherein the heat exchanger is included in an air-conditioning apparatus.

9. The distributor of claim 7, wherein the heat exchanger is included in an air-conditioning apparatus.

* * * * *